US010532446B2

(12) United States Patent
Deane

(10) Patent No.: US 10,532,446 B2
(45) Date of Patent: Jan. 14, 2020

(54) CANVAS STRETCHING TOOL

(71) Applicant: Walter Clarence Deane, Rockport, TX (US)

(72) Inventor: Walter Clarence Deane, Rockport, TX (US)

(73) Assignee: Walter Clarence Deane, Kimberling City, MO (US)

( * ) Notice: Subject to any disclaimer, the term of this patent is extended or adjusted under 35 U.S.C. 154(b) by 198 days.

(21) Appl. No.: 15/226,506

(22) Filed: Aug. 2, 2016

(65) Prior Publication Data

US 2017/0087694 A1 Mar. 30, 2017

Related U.S. Application Data

(60) Provisional application No. 62/202,266, filed on Aug. 7, 2015.

(51) Int. Cl.
*B25B 7/04* (2006.01)
*B25B 7/12* (2006.01)
*B44D 3/18* (2006.01)

(52) U.S. Cl.
CPC ..... *B25B 7/04* (2013.01); *B25B 7/123* (2013.01); *B44D 3/185* (2013.01)

(58) Field of Classification Search
CPC .. B25B 7/02; B25B 7/04; B25B 7/123; D06C 3/08; B44D 3/185
USPC ..... 38/70, 102
See application file for complete search history.

(56) References Cited

U.S. PATENT DOCUMENTS 2,514,130 A * 7/1950 Jones ..... B25B 7/123 269/228
2,608,793 A * 9/1952 Gant ..... B68G 15/00 140/123.5
D253,088 S * 10/1979 Levin ..... D8/52
4,181,046 A * 1/1980 Lamb ..... B25B 7/00 140/123.5
6,983,524 B2 * 1/2006 Eastwood ..... B25B 7/02 29/428
D605,917 S * 12/2009 Sands ..... D22/150
8,495,828 B1 * 7/2013 Feldman ..... B25B 7/123 294/16

* cited by examiner

*Primary Examiner* — Ryan A Reis

(57) ABSTRACT

Disclosed is a handheld canvas stretching tool used to stretch canvas across a stretcher frame. The tool can include upper and lower jaw plates with slip resistant surfaces configured to firmly grasp a portion of the canvas to be stretched. The tool includes wide "locking pliers" technology, and a second class lever action. These features give the user the mechanical advantage needed to apply a taut stretch to the canvas, while permitting one hand, and sometimes both hands, of the user to be free to apply staples that secure the canvas to the stretcher frame.

20 Claims, 15 Drawing Sheets

CANVAS STRETCHING TOOL

RELATED APPLICATIONS

This application claims the benefit of U.S. Provisional Application No. 62/202,266, entitled "The Grabber Handheld Canvas Stretching Tool" and filed on Aug. 7, 2015, which is incorporated herein by reference in its entirety.

FIELD

This application relates generally to tools for preparing an art canvas and, more particularly, to canvas stretching tools.

BACKGROUND

Some implementations relate generally to the construction of art media, specifically canvas stretched across a frame (e.g., a stretcher frame or stretcher bars). Stretcher frame construction is an independent but related initial step in the creation of this media. Stretched canvas may tend to rebound and relax over time. This can result in wrinkles appearing on the face of the canvas, which is not acceptable. A need may exist for a tool that provides a user with the mechanical advantage necessary to stretch a canvas taut enough to help prevent undesirable wrinkles from occurring over time.

Some implementations were conceived in light of the above-mentioned problems and limitations, among other things.

DETAILED DESCRIPTION

Figure 1:
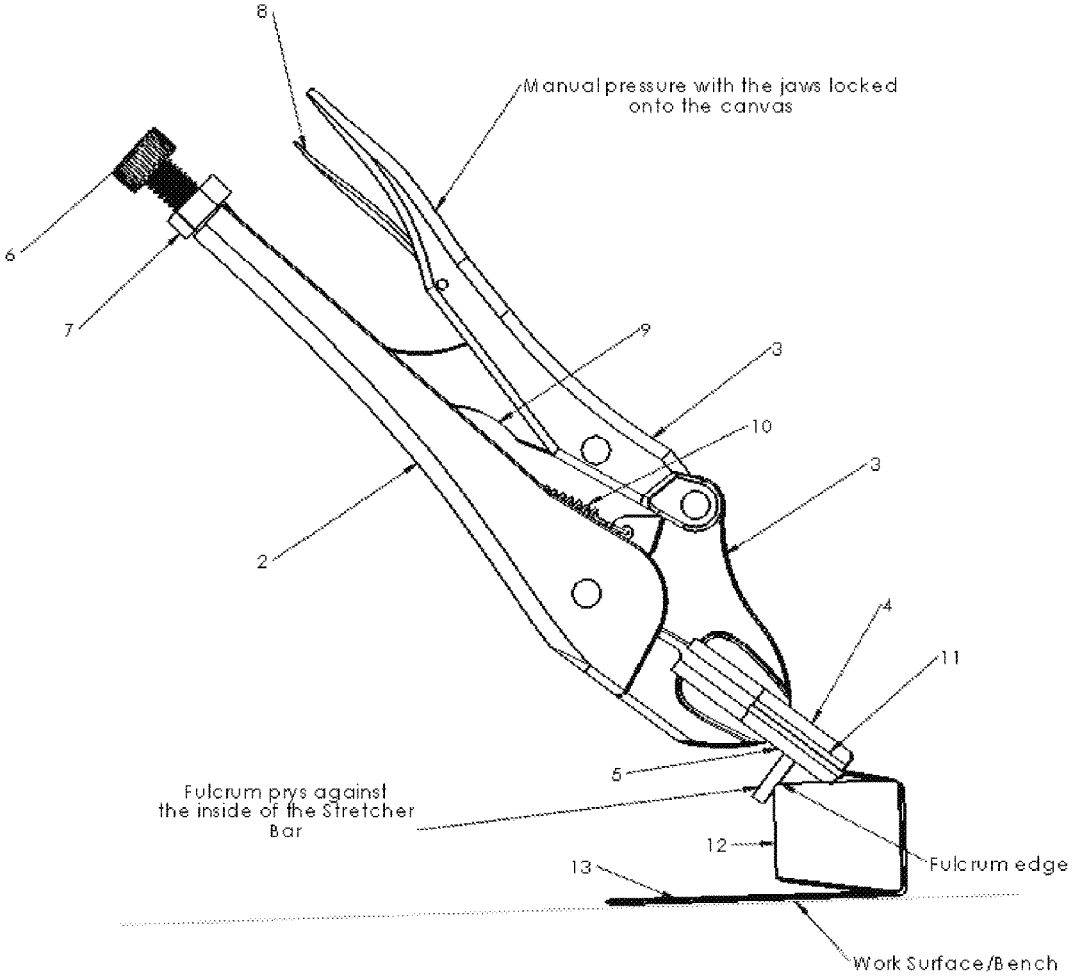
FIG. 1 shows a profile view of an example canvas stretching tool as it would be used to apply a stretch to canvas in accordance with some implementations.

Some implementations can provide a tool to stretch canvas across a stretcher frame tight enough so as to help eliminate the possibility that wrinkles will appear on the face of the canvas (and the art painted or printed thereon) over time, and to achieve this with a light, handheld tool that is easy to use, and affordable. Some implementations can provide a tool to apply a uniform stretching force to canvas across any stretcher frame (e.g., 16 mm or thicker), while permitting the user to have one or both hands free to apply staples and or tacks as well as any other securing means that will secure the canvas to the back or the outside of the stretcher frame, with a minimum of effort. To achieve this, the disclosed tool can be equipped with a fulcrum, which gives the user the mechanical advantage to apply a taut stretch to the canvas. Some implementations can also provide an ability to grip and lock securely onto the canvas, thereby allowing one hand operation. This allows the user to engage the other hand, and sometimes both hands, to apply the staples that will hold the canvas in place in the taut position.

Some implementations can include an improvement over what may be known as "locking pliers" such as those designed to grasp and bend metal along a straight line. Some implementations can include a wide "locking jaw" feature of these conventional locking pliers. However, some implementations can add a number of improvements and modifications to conventional locking pliers to make them especially useful for stretching canvas. Specifically, the modifications can include a slip resistant material added to the inside face of the jaw plates to help provide a fixed grasp on the canvas, and a fulcrum (e.g., a second class fulcrum) that is used to lever against the inside of the stretcher frame and apply stretching action on the canvas. The fulcrum can give the user the mechanical advantage to apply an especially taut stretch on the canvas. In addition to the fixed fulcrum, a fulcrum that may be spring loaded to allow for a precise and repeatable level of tension on the canvas is described.

Some implementations can include a unique fulcrum point, and a canvas grasping improvement, consisting of a slip resistant surface, that may either be etched into the jaws or consist of a self adhesive slip resistant material on the inside faces of the jaw plates. There are several slip resistant, grasping materials that are suitable for this use with the described tool. One particularly suitable material that has proven to work well is 3M 1 Inch Safety-Walk Medium Duty Resilient Tread. This non-slip grasping technology has a very low production cost, and is very effective at grasping the canvas that is to be stretched.

The use of an improvement in locking pliers, sometimes used in metalworking arts, may substantially reduce the production cost of an implementation. The design of the canvas stretcher tool described herein is an improvement to conventional locking pliers that may consist of modifications to the existing production tooling and fabricating processes in order to mass produce the device improvements described herein. This translates to lower tooling and production costs, lower cost to the end consumer, and perhaps increased U.S. exports to other countries, because the market for this device is world-wide, thereby affording more utility to the described matter.

There is another design feature that may make the present disclosure superior to conventional systems. Conventional systems may be missing a feature that makes it necessary to occasionally adjust the pressure applied to the locking jaws. This is a particular annoyance for the user. Some implementations include a lock nut on the jaw pressure adjustment bolt. This allows the user to set the grabbing pressure of the jaw plates, and lock that pressure setting into place by tightening the nut. In so doing, users may not need to re-adjust the grabbing pressure of the jaws for sustained periods of time, if ever.

Some implementations can include low production cost, light weight, and ease of use. Light weight means less user strain and user fatigue, especially in the hands and forearms, when stretching several canvases in succession. The small size and light weight of some implementations also means lower shipping and distribution cost, and ultimately, lower cost to the consumer.

Some implementations help the user apply the canvas (or any other suitable fabric) to the stretcher frame in a uniform and taut manner, thereby completing the construction of the art media. It can be difficult to stretch the canvas taut enough to resist wrinkling without using a canvas stretching tool such as the tool described herein.

FIGS. 1, 8, 9 and 10 show profile views of example canvas stretching tools illustrating how a user prepares to stretch a canvas. The user can start by adjusting and locking the pressure to be applied to the jaw plates 4, 5 using the pressure adjustment bolt 6 and lock nut 7. The user then proceeds to grasp in between the upper and lower jaw plates 4, 5 a portion of the canvas 13 to be stretched. In so doing, the user allows just enough slack in the canvas 13 for the user to just barely apply the nose of the fulcrum 1 to the top inside edge of the stretcher frame 12. The user then locks the jaw plates 4, 5 onto the canvas 13 by grasping the lower stationary arm 2 and upper pivoting arm 3 and squeezing them together until they snap into place. The canvas stretching tool is now properly positioned to apply a stretch to the canvas 13. The user then manually applies downward pressure to the upper pivoting arm 3, pressing it all the way downward to the back face of the canvas 13. This causes the fulcrum 1 to slide down the inside face of the stretcher frame 1Z thus applying a stretch to the canvas 13. The user can then apply staples to hold this stretched portion of canvas 13 in place. After doing so, the user can then release the canvas 13 using the pressure release lever 8. This process is repeated around the outer perimeter of the stretcher frame 12 so as to completely stretch the canvas 13 tightly in all directions across the frame.

Figure 2:
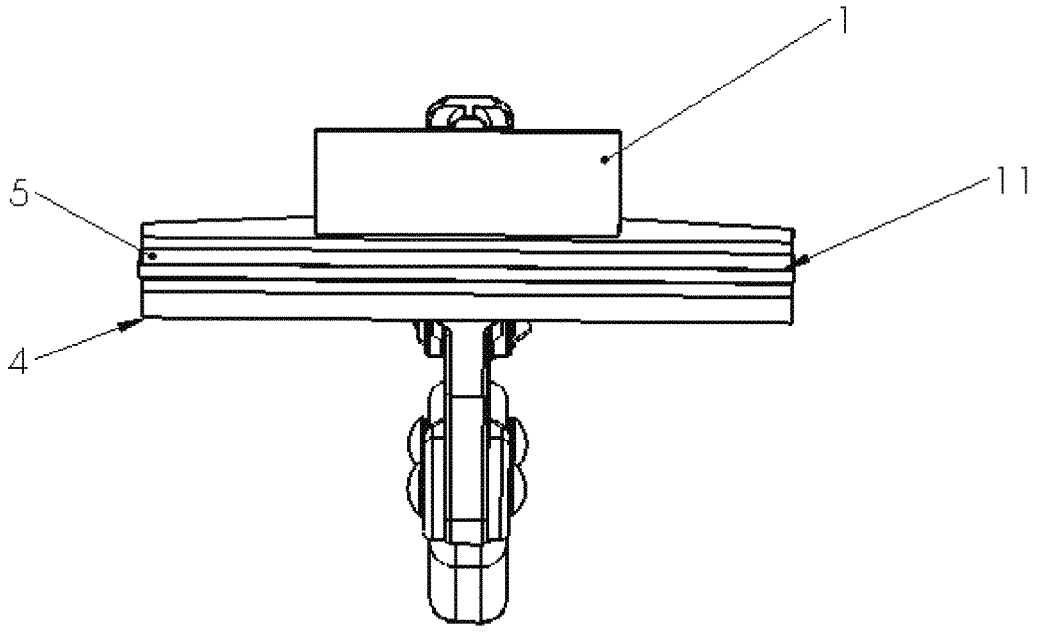
FIG. 2 shows an end view of an example canvas stretching tool looking at the nose of the jaw plates in accordance with some implementations.

FIG. 2 is an end view of an example canvas stretching tool looking at the nose of the jaw plates. FIG. 2 shows two key elements of the canvas stretching tool: the preferred position of the fulcrum 1 and the slip resistant surface 11 applied to the inside face of the upper and lower jaw plates 4, 5.

Figure 3:
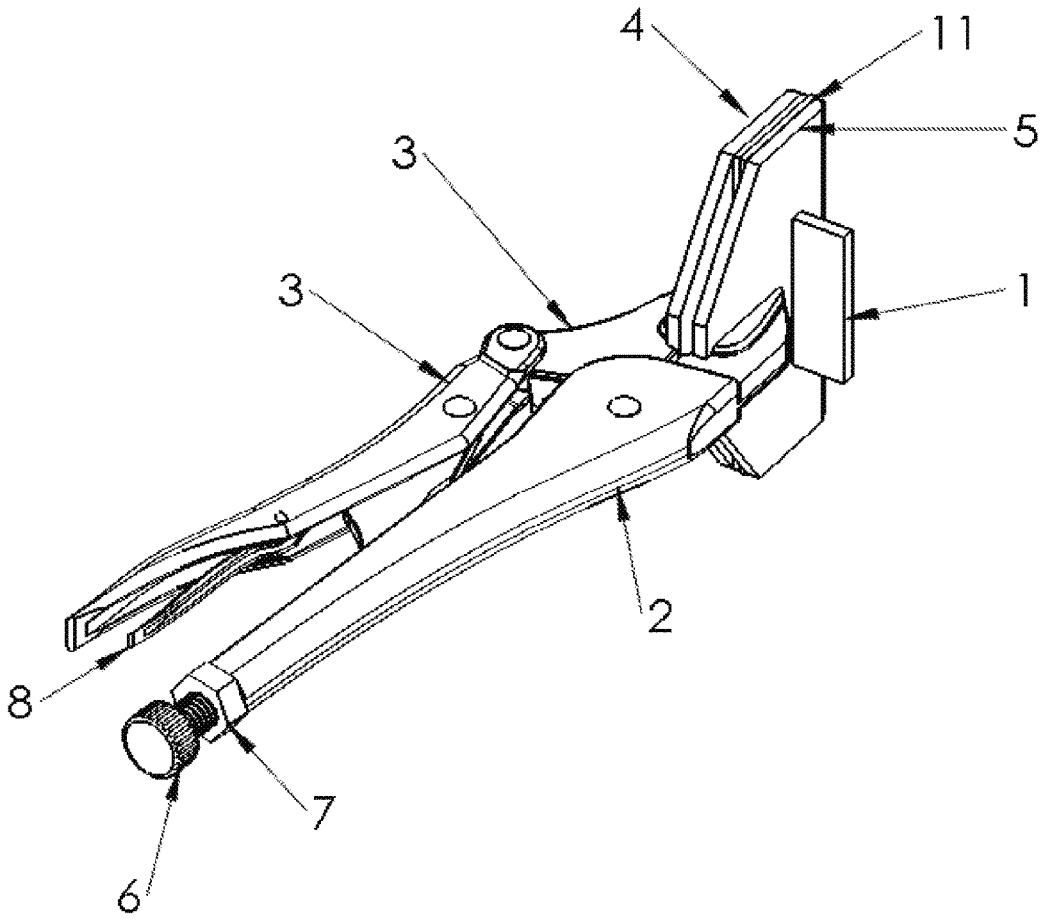
FIG. 3 shows an angled 3D view of an example canvas stretching tool in accordance with some implementations.

FIG. 3 is an angled 3D view of an example canvas stretching tool. It shows the preferred position of the fulcrum 1 on the lower jaw plate 5, the lower stationary arm and jaw assembly 2, the upper pivoting locking arm and jaw assembly 3, the upper jaw plate 4, the pressure adjustment bolt 6, the lock nut for the pressure adjustment bolt 7, the pressure release lever 8, and the slip resistant material 11 applied to the inside faces of the upper and lower jaw plates 4, 5.

Figure 4:
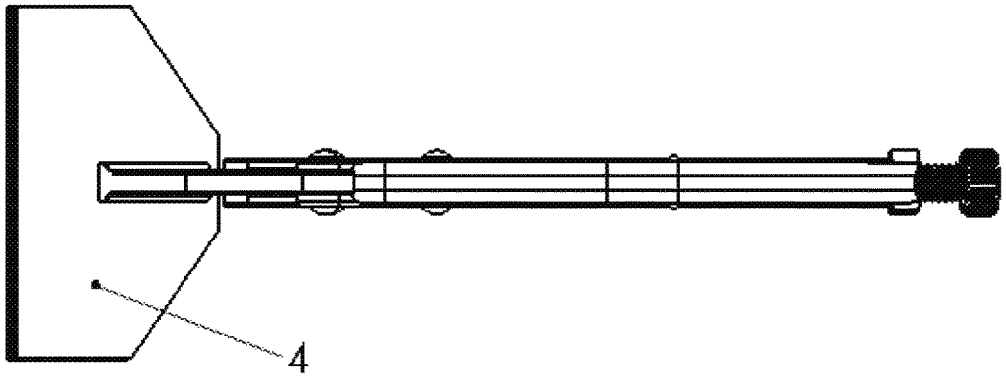
FIG. 4 shows a plan view of the topside of an example canvas stretching tool in accordance with some implementations.

FIG. 4 is a plan view of the top side of an example canvas stretching tool. It shows the angle on the back corners of the upper jaw plate 4, where upper jaw plate 4 material is removed to minimize the weight, and to conserve materials. More or less of this material could be removed for the same purpose, as this portion of the jaw plate does not perform any work.

Figure 5:
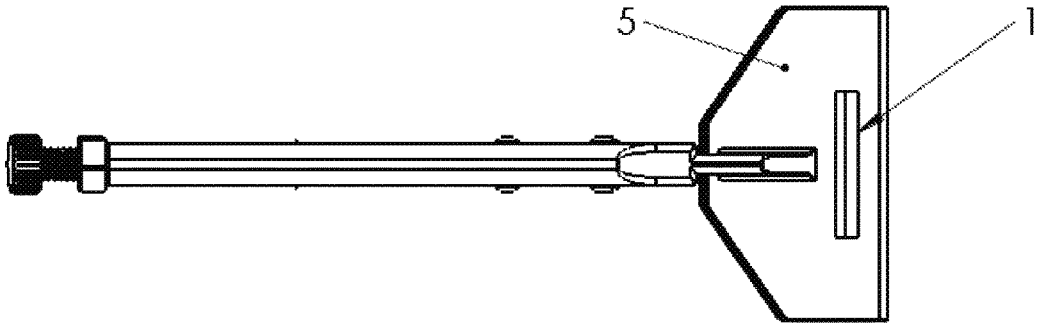
FIG. 5 shows a plan view of the bottom side of an example canvas stretching tool in accordance with some implementations.

FIG. 5 is a plan view of the bottom side of an example canvas stretching tool. It shows the preferred position of the fulcrum 1 on the back face of the bottom jaw plate, and the angles on the back corners of the bottom jaw plate 5, where bottom jaw plate 5 material is removed to minimize the weight, and to conserve materials. More or less of this material could be removed for the same purpose, as this portion of the jaw plate does not perform any work.

Figure 6:
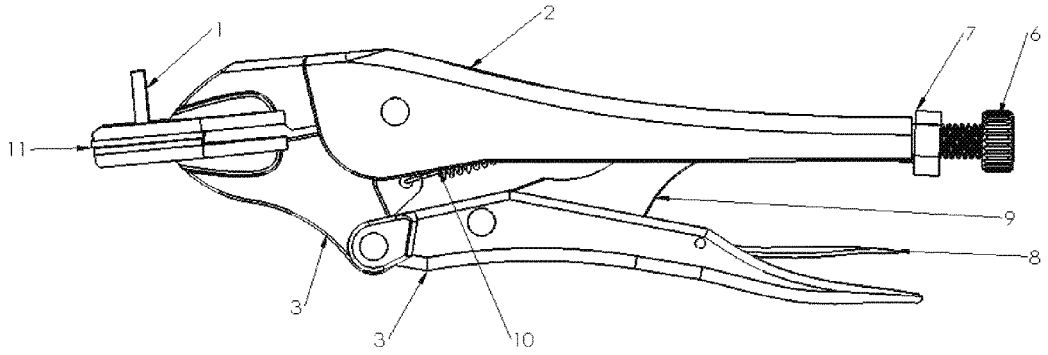
FIG. 6 shows an inverted profile view of an example canvas stretching tool in accordance with some implementations.

FIG. 6 shows an inverted profile view of an example canvas stretcher. It simply provides a slightly different view of most of its moving parts, the fulcrum 1, the lower stationary arm and jaw assembly 2, the upper pivoting locking arm and jaw assembly 3, the pressure adjustment bolt 6, the lock nut for the pressure adjustment bolt 7, the pressure release lever 8, the pivoting pressure transfer arm 9, spring 10, and the slip resistant material 11 on the inside face of the upper and lower jaw plates 4, 5.

Figure 7:
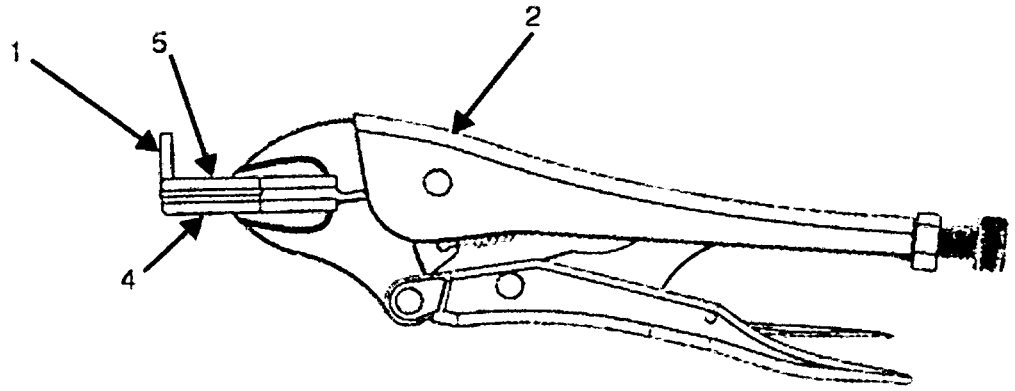
FIG. 7 shows one implementation with the fulcrum positioned forward on the distal edge of the lower jaw plate. This implementation is especially useful for stretching large canvases.

FIG. 7 shows one implementation that can be used to stretch both large and small canvases, but may be best suited for stretching large canvases because when properly used it can apply about 16 mm (⅝ inch) of stretch, which may be sufficient for canvases several feet in length or width. A difference between this implementation and other implementations can include the completely forward position of the fulcrum 1. All other components are similar to those shown in FIG. 1.

Figure 8:
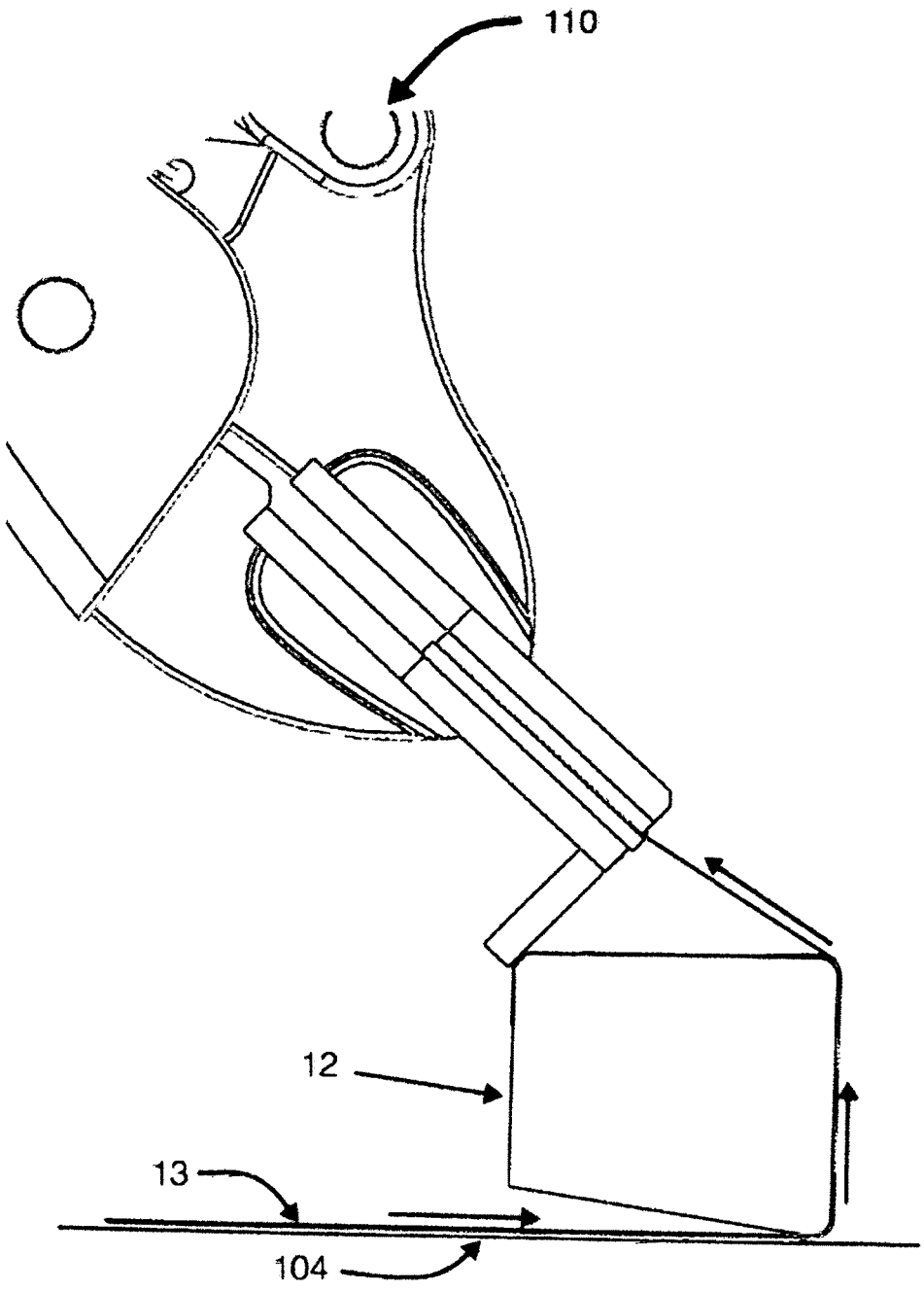
FIG. 8 shows one implementation being positioned to start a canvas stretching cycle, with the tip of the fulcrum barely catching the inside edge of the stretcher frame, and ready to apply downward force to the upper arm of the device.

FIG. 8 shows the implementation in FIG. 7 being positioned to start a canvas stretching cycle. After adjusting and locking the pressure setting with the pressure adjustment bolt and lock nut 6, 7, (Shown in FIG. 1) the user places the tool in the inverted position on the back side of the stretcher frame 12. Then the user gathers excess canvas material and places the edge of the canvas 13 between the lower and upper jaw plates 4, 5, and locks the device onto the canvas 13 by squeezing the upper and lower arms 2 and 3 (Shown in FIG. 1) until the device locks firmly. In so doing, the user allows just enough slack in the canvas 13, to position the fulcrum 1 against the inside edge of the stretcher frame 12. The user then applies downward force 110 to the upper arm 3 (Shown in FIG. 1) to initiate the stretch.

Figure 9:
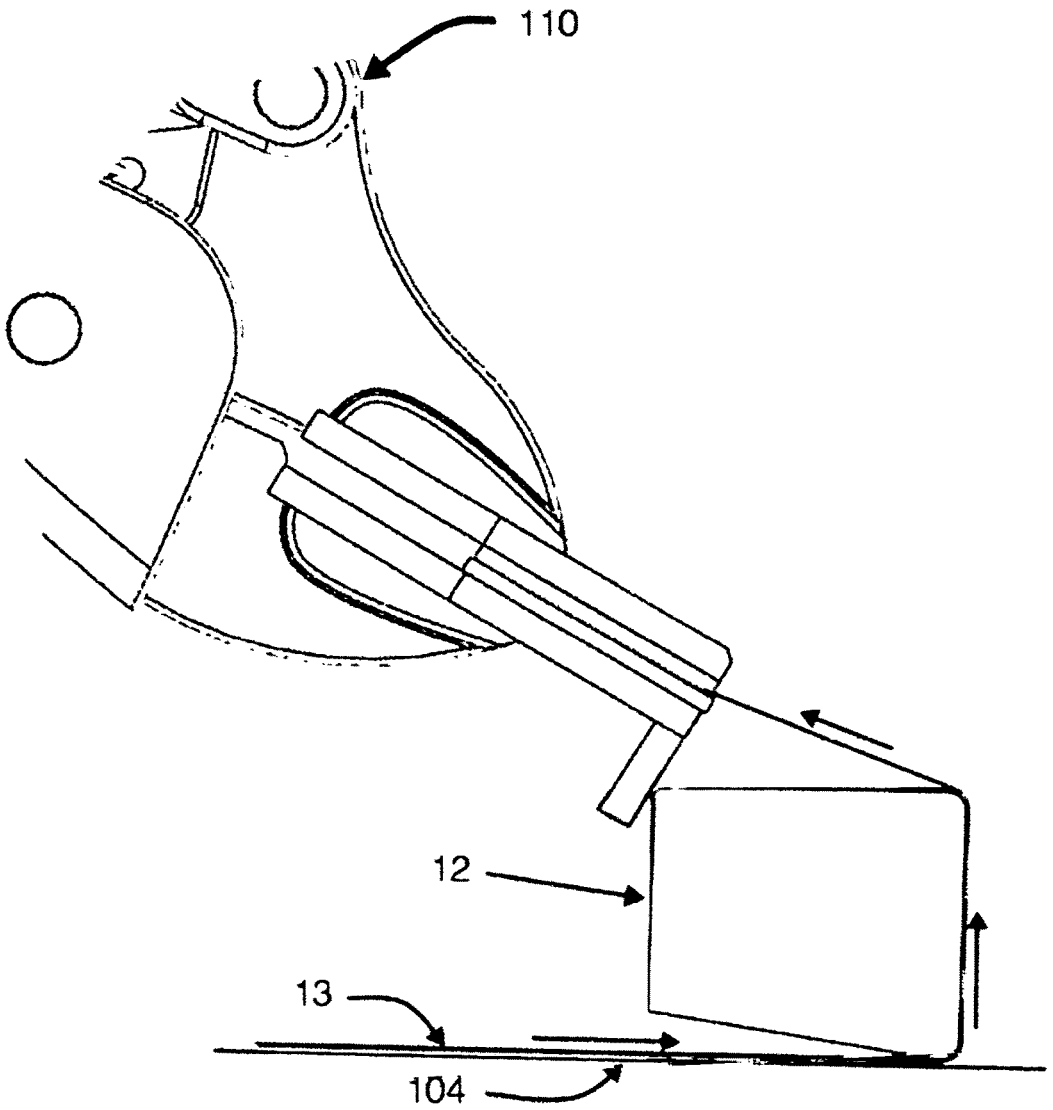
FIG. 9 shows one implementation midway through a stretching cycle with the fulcrum starting to slide down the inside face of the stretcher frame, as force is being applied to the upper arm of the device.

FIG. 9 shows the implementation in FIG. 7 midway through a stretching cycle. As the user applies more force 110 to the upper arm 3, (Shown in FIG. 1) the fulcrum 1 starts to slide down the inside face of the stretcher frame 12, causing the canvas 13 to stretch.

Figure 10:
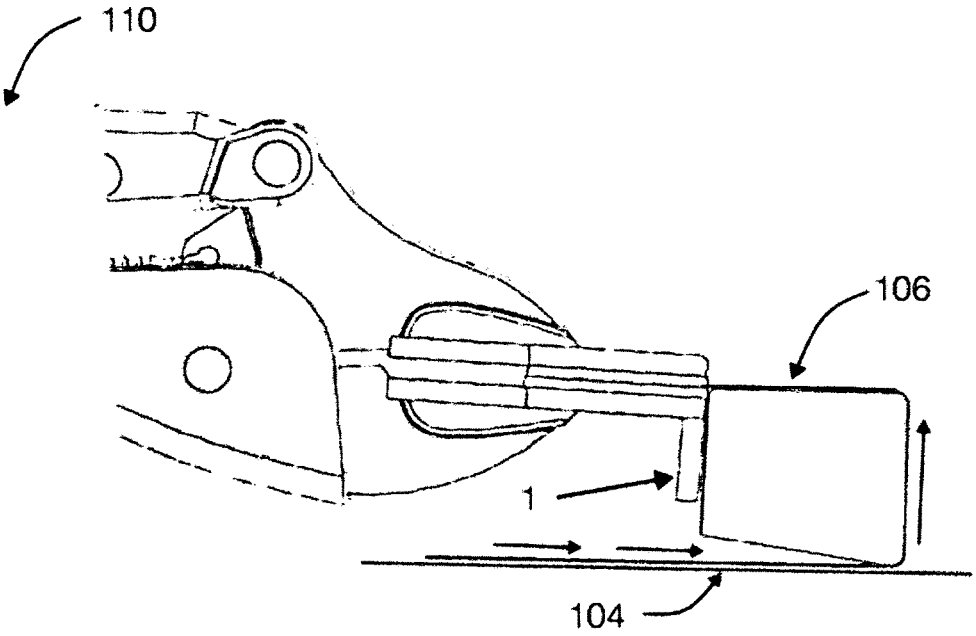
FIG. 10 shows one implementation positioned at the end of a stretching cycle with little or no downward force needed to hold the stretch in place. Staples can now be applied to the back side (or the outside) of the stretcher frame to hold the canvas permanently in place.

FIG. 10 shows the implementation in FIG. 7 as it might be positioned at the end of a successful stretching cycle. The stretching cycle is complete at this point, and because the fulcrum 1 is now completely flush with the inside face of the stretcher frame 12, very little or no downward force 110 on the upper arm 3 is needed to hold the stretch in place. The user now has one or both hands free to apply staples at 106 to the back side (or the outside) of the stretcher frame 12 to hold the canvas 13 permanently in place. With this stretching cycle being complete, the user then releases the canvas 13, using the pressure release lever 8 (Shown in FIG. 1) and repeats the steps depicted in FIGS. 8, 9 and 10 around the complete outer perimeter of the stretcher frame 12 to stretch the canvas 13 evenly in all directions across the stretcher frame 12.

Figure 11:
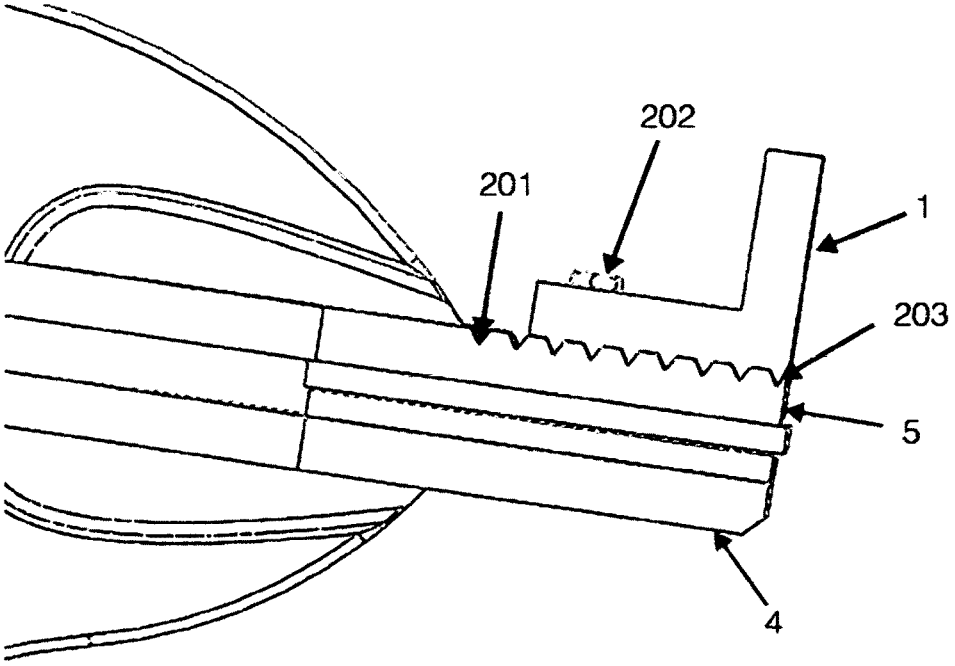
FIG. 11 shows a side view of an adjustable version embodiment of the described utilizing an adjustable fulcrum.

FIG. 11 shows a variation of the canvas stretching tool of FIG. 7 that shows another variation of the fulcrum 1 in the completely forward position but features a fulcrum 1 that may be adjustable along a guide member on the lower jaw plate 5 that is formed by the use of a number of rails 203 and grooves 201 that match to provide a secure assembly that includes a set screw and bolt assembly 202 that can be tightened to secure the fulcrum 1 at a given position on the guide and loosened to permit the fulcrum 1 to move freely along the guide to allow for various setbacks using a guide and groove arrangement. While it may be more costly to provide for adjustability of the fulcrum we disclose one of the many methods to provide for adjustment of the fulcrum 1 using a rugged and secure means of providing for a very strong assembly while providing an easy means of adjustment.

Figure 12:
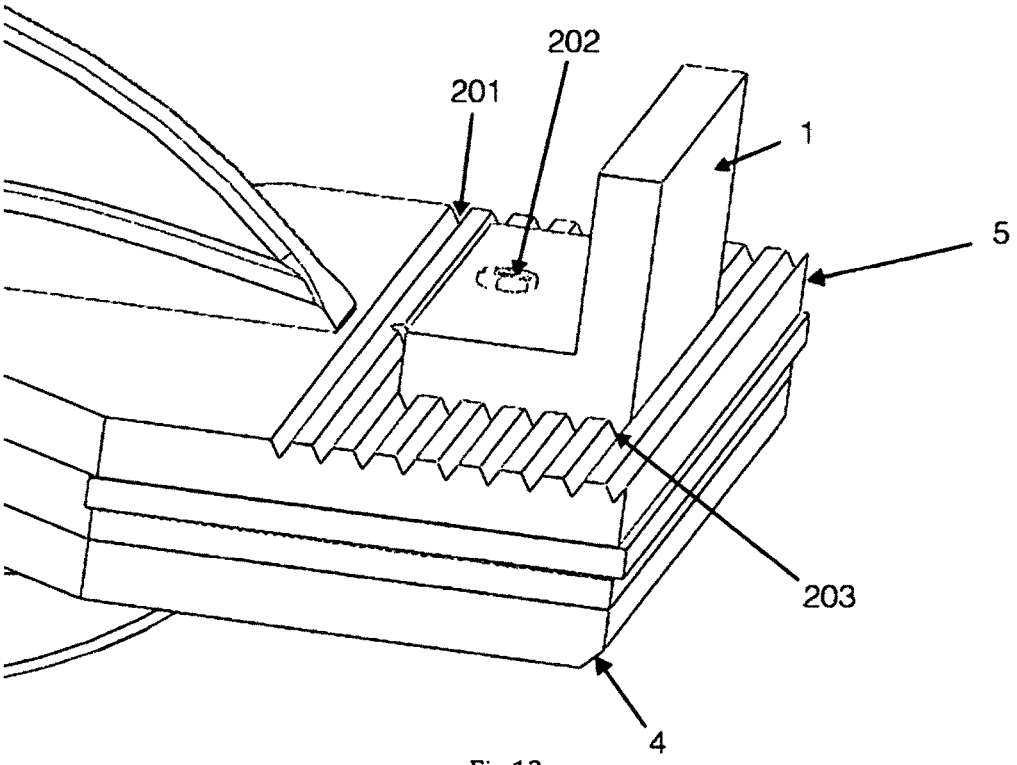
FIG. 12 shows a top perspective view of an adjustable version embodiment of the described utilizing an adjustable fulcrum with the fulcrum set back from the edge of the jaw plate.

FIG. 12 shows the tool of FIG. 11 with the fulcrum 1 set back in the second set of rails 203 and grooves 201 to provide for the specific needs of the user.

Figure 13:
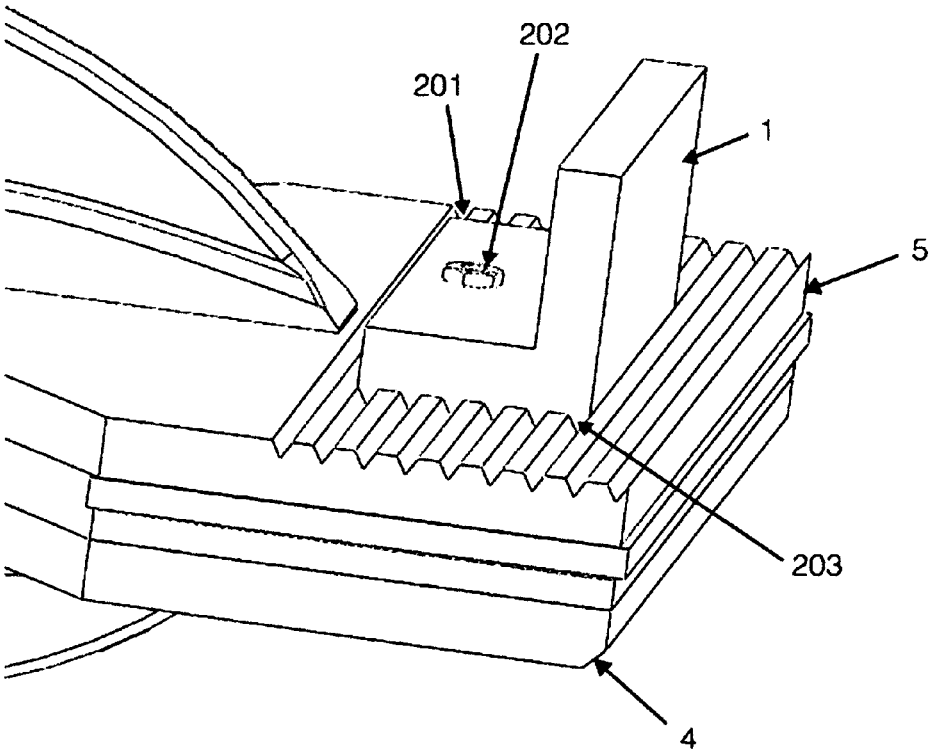
FIG. 13 shows a top perspective view of an adjustable version embodiment of the described utilizing an adjustable fulcrum with the fulcrum set back from the edge of the jaw plate.

FIG. 13 shows 12 with the fulcrum 1 set back in the third set of rails 203 and grooves 201 to provide for the specific needs of the user.

Figure 14:
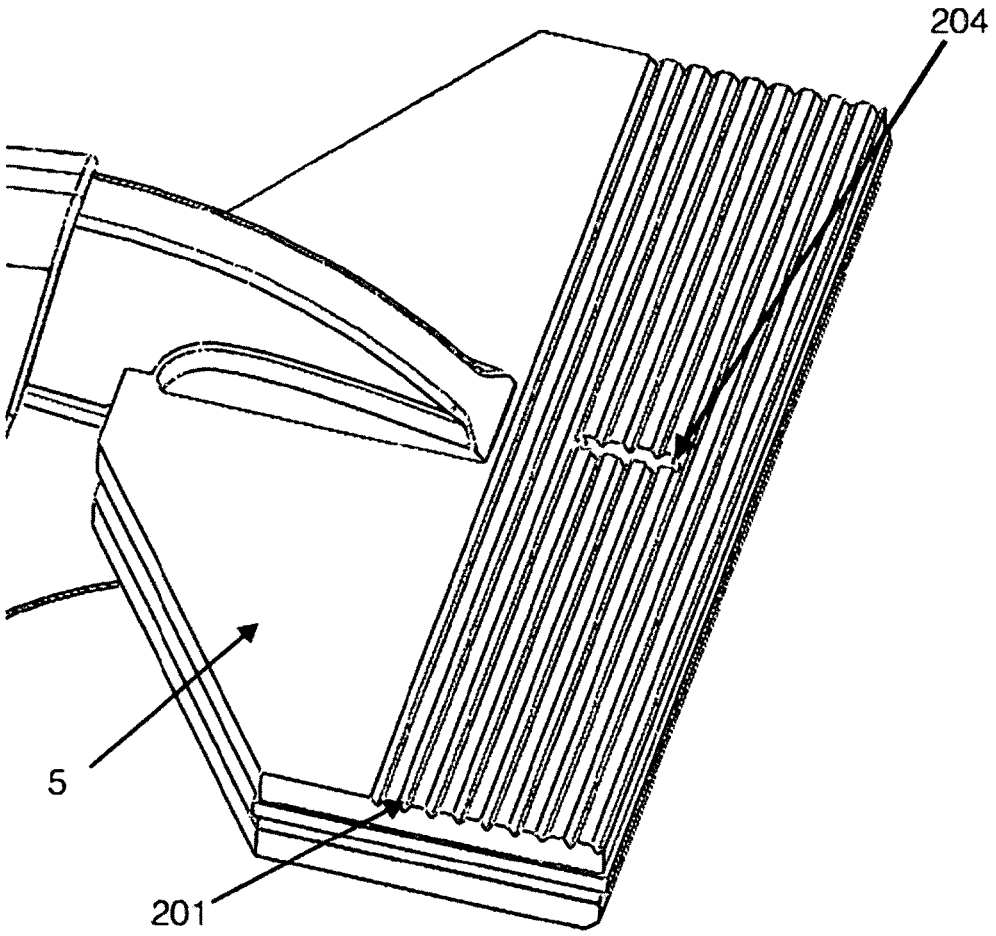
FIG. 14 shows a top perspective view of the top jaw plate with an obround hole for the set screw used to secure the adjustable fulcrum to the top jaw plate.
Figure 15:
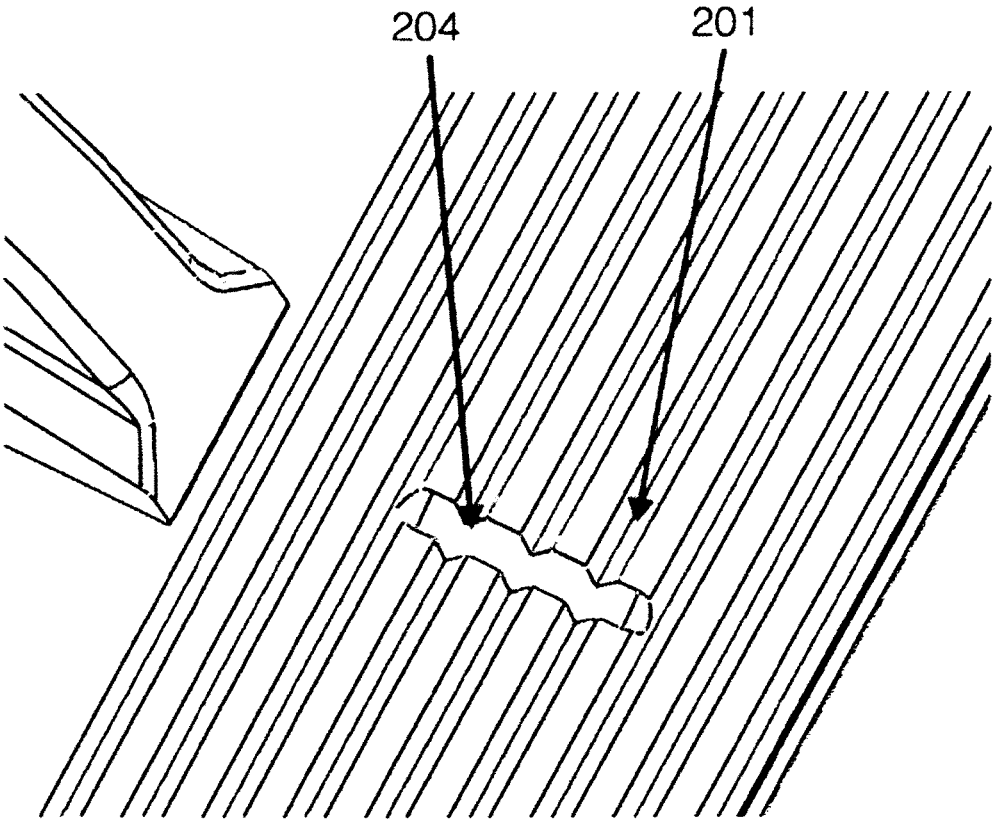
FIG. 15 shows a close up view of the obround hole in the top jaw plate.

FIG. 14 shows the Obround Hole 204 for the Set Screw bolt to allow for adjustment of the location of the fulcrum.

FIB. 15 shows a close up of the Obround Hole 204 for the Set Screw bolt to allow for adjustment of the location of the fulcrum. As well we show a close up of the grooves 201.

An objective and purpose of the canvas stretcher tool is to stretch the canvas 13 across a stretcher frame 12 tight enough so as to help reduce or eliminate the possibility that wrinkles will appear on the face of the canvas 13 (and the art painted thereon) over time, and to do so with a handheld tool that is easy to use and affordable. Some implementations provide the user with an ability to apply a uniform taut stretch to canvas 13 across stretcher frames 12 that are about 16 mm or thicker, while allowing the user to have at least "one hand free" to apply staples, tacks, or any other securing means, that will secure the canvas 13 to the back or the outside of the stretcher frame 12, with a minimum of effort. To achieve this, the device is equipped with locking jaw plates 4, 5 and a fulcrum 1. The locking jaw plates 4, 5 grasp the canvas 13 firmly and the fulcrum 1 is used to lever against the inside of the stretcher frame 12, to apply a taut stretch to the canvas 13. The locking jaw plates 4, 5 allow one hand operation, and this in turn allows the user to engage the other hand to apply the staples that will hold the canvas in place in the taut position.

Some implementations can include a wide "locking pliers" technology commonly found in tools that are designed to grasp and bend metal along a straight line. Some implementations can include a wide "locking jaw" feature of these metalworking tools. Some implementations add some modifications and novel improvements to these metal working "locking pliers" to make them especially useful for stretching canvas 13. Specifically, those modifications include a slip resistant material 11 added to the inside face of the jaw plates 4, 5 to assure a fixed grasp on the canvas, and a fulcrum 1 used to lever against the inside of the stretcher frame 12 to apply stretching action on the canvas 13.

Some implementations include a fulcrum point 1 and a canvas 13 grasping technology consisting of a slip resistant material 11 on the inside face of the upper and lower jaw plates 4, 5. There are several grasping surfaces that are suitable for this use on the present invention. One particularly suitable gripping surface proven to work well is the 3M 1 Inch Safety-Walk Medium Duty Resilient Tread. This self adhesive, slip resistant grasping technology has a very low production cost and is very effective at grasping the canvas 13 that is to be stretched.

The use of an improvement to locking pliers belonging to the locking metal working plier class of tools should substantially reduce the production cost of the canvas stretching tools described herein. The design is similar to conventional locking pliers, and very few modifications to the existing production tooling and fabrication processes will be needed to mass-produce the improvements in the disclosed device. This translates to lower tooling and production costs, lower cost to the end consumer, and perhaps increased U.S. exports to other countries, as the market for this device may be worldwide.

There is another design feature of the disclosed subject matter that makes it superior to other conventional locking pliers and canvas stretching systems that may poke holes in the canvas subjecting it to tearing. Conventional canvas stretching pliers may be missing a feature that permits a user to occasionally adjust the pressure applied to the locking jaws. This is a particular annoyance for the user. Some implementations can include a lock nut 7 on the jaw pressure adjustment bolt 6. This allows the user to set the grabbing pressure of the jaws, and lock that pressure setting into place by tightening the lock nut 7. In so doing, users may not need to re-adjust the grabbing pressure of the jaws for sustained periods of lime, if ever.

The disclosed canvas stretching tool gains merit over conventional systems by it's low production cost, its light weight, and ease of use. Having light weight means can provide less strain and less user fatigue, especially in the hands and forearms of the user, when stretching several canvases in succession. Its smaller size and weight also reduces transportation and distribution costs.

Some implementations can include modifications to existing unrelated art, namely the art belonging to the multitude of manufacturers of, such as metal working flat jaw locking pliers. Described below is one example canvas stretching tool where we will with a focus on two design features of the embodiment of the pliers: 1) the wide jaws, most of which are typically about 75 mm to 80 mm wide; and, 2) the locking pressure feature. That being said, some plier's designs are better suited than others to be adapted for use as canvas stretchers.

Regardless of the pliers manufacturer and the specific design of the pliers, in some implementations, locking pliers of the described improvement have a fulcrum 1 disposed on the outside face of the lower jaw plate 5 in order to be used as canvas stretchers. While the fulcrum may be fixed it is another improvement of the device to have a fulcrum that is biased with a spring to afford a uniform and controllable stretching force to the canvas. Such a fulcrum, either fixed or with a spring bias gives the user the mechanical advantage to apply an adequate stretch to the canvas 13. The fulcrum may also be adjustable in some implementations. For example, the fulcrum may be attached to the jaw plate via an adjustable mechanism such as a track, rail or groove that the fulcrum can move along (e.g., to give a variable distance between the fulcrum and the front edge of the jaw plate) and a securing member such as a set screw, bolt or other member that can be tightened to secure the adjustable fulcrum at a desired position on the outside surface of the lower jaw plate in order to perform a stretching operation. The set screw or other securing member may then be loosened to permit the fulcrum to be moved to a different position on the jaw plate to permit a second, different stretching operation to be performed.

There are other improvements that may be included in the device, but the number of modifications necessary to adapt these designs to canvas 13 stretching may or may not be dependent on the hardness and or the rigidity of the material in the upper and lower jaw plates 4,5.

Many of the manufacturers of these metal bending tools use a low to medium grade of carbon steel in the jaw plates 4, 5. This is suitable material for the purposes for which these metal bending tools were designed. However, the applicant has found that the lower grade alloys of this class may distort, and eventually fatigue over time, the result of which is jaw plates 4, 5 that fail to grasp evenly across the full width of the plate. This is not acceptable. However, this doesn't necessarily mean that these tools can't be used to construct a good canvas 13 stretching tool. Other disclosed features address this condition, such as to flatten the angle at which the upper and lower jaw plates 4,5 meet, and to treat the mating surfaces with a material similar or equal to self adhesive slip resistant material 11. These adaptations allow such a device to grasp and hold the canvas 13 adequately. While we describe metal alloys for use in making canvas stretching tools as described herein, other materials can be used such as a suitable carbon fiber material with associated gripping geometry that will afford the necessary grip along with required rigidity.

It is well known that, a few of these metal working tool manufacturers use high grade carbon steel throughout the construction of their tool, including the materials going into the upper and lower jaw plates 4,5. The applicant has found that these tools are especially well suited as canvas stretcher tools because the jaw plates 4,5 do not distort, and grasp the Canvas 13 evenly and adequately across the full width of the jaw. These tools are especially good candidates for canvas stretching because the only modification necessary is the addition of a fulcrum 1 on the outside surface of the lower jaw plate 5 and the application of the self adhesive slip resistant material to the inside faces of the jaw plates 4,5. Although a particular manufacturer may use high carbon steel in their jaw plates, it may be necessary to flatten the angle at which the upper and lower jaw plates 4,5 meet so as to improve the grasping power of the jaw plates 4,5 and eliminate any canvas 13 slippage that might take place. The need for this improvement depends on the hardness of the jaw plates 4, 5, which can vary substantially, and the amount of plate distortion that takes place when the tool is adjusted to a high range of pressure.

The following is a description of some implementations of the disclosed subject matter, and variations thereof. The discussion of variations should not be construed as limiting the present invention to any of those variations.

The preferred width of the jaw plates 4, 5 at the grasping face is about 75 mm to 80 mm. This dimension is well-suited for most artwork applications as well as ideal for certain upholstery stretching tasks. This width also happens to be the nominal width of most metal bending locking pliers. Jaw plate 4, 5 widths as narrow as about 30 mm to 45 mm are also practical for stretching in close proximity to the stretcher frame corners. Jaw widths greater than about 80 mm may be appropriate depending on the mechanical properties of the jaw plate material. Jaw plate material of high carbon steel material might allow a jaw width of about 100 mm or more while other alloys as well as carbon fiber materials may be more appropriate and afford an even lighter tool.

The noses (the leading edges) of the upper and lower jaw plates 4, 5 on the preferred and all alternative embodiments may be blunt or chamfered at about a 30 to 40-degree angle, or have a similar radius. This angle or radius could vary substantially. This feature makes it easy for the user to snug the canvas 13 against the back side of the stretcher frame 12 just before applying the staples, tacks or other securing means that secure the canvas 13.

The back corners of the upper and lower jaw plates 4, 5 can be trimmed at about a 30 degree to 40 degree angle to conserve weight and materials, as shown in FIG. 4. More or less of this material could be removed, as this portion of the jaw plate does not perform any work.

One preferred slip resistant material 11 for treatment of the grasping face of the upper and lower jaw plates 4, 5 is 3M 1 Inch Safety-Walk Medium Duty Resilient Tread (or equivalent or similar material) as shown in multiple figures. There may be several other materials that are just as suitable as well as appropriate geometry etched or molded into the jaw faces in either plastic, metal, or carbon fiber versions. This slip resistant material 11 is most effective when it spans the full width of both jaw plates 4, 5 no matter the width of the jaw plate.

The preferred angle at which the upper and lower jaw plates 4, 5 meet one another may vary from zero to ten degrees depending on the mechanical properties of the jaw plate material. An angle within these limits assures sufficient contact between the slip resistant material 11 and the canvas 13. FIGS. 1, 2, 3, and 6 show a near zero degree angle between the upper and lower jaw plates 4, 5. This angle may also be greater than 5 degrees if the jaw plates 4, 5 are made of high carbon steel, or are hard enough to not distort under high-pressure settings, and grasp the canvas 13 securely.

One preferred width of the fulcrum 1 is approximately 30 percent to 50 percent of the width of the upper and lower jaw plates 4, 5.

One preferred height of the fulcrum 1 may be from about 12 mm to 20 mm.

One preferred position of the fulcrum 1 may be from about 10 mm to 16 mm back from the nose (the leading edge) on the outside surface of the lower jaw plate 5, and nearly perpendicular, or within about +/−30 degrees of perpendicular, to the outside surface of the lower jaw plate 5, and nearly centered on the width of the lower jaw plate 5. See FIGS. 1, 3 and 5. The fulcrum 1 may also be affixed at the center of the distal (leading) edge on the outside surface of the lower jaw plate 5.

It is, therefore, apparent that there is provided, in accordance with the various example implementations disclosed herein, canvas stretcher tools.

While the disclosed subject matter has been described in conjunction with a number of implementations, it is evident that many alternatives, modifications and variations would be or are apparent to those of ordinary skill in the applicable arts. Accordingly, Applicant intends to embrace all such alternatives, modifications, equivalents and variations that are within the spirit and scope of the disclosed subject matter.

What is claimed is:

1. A canvas stretching tool comprising:

an upper pivoting locking arm assembly including an upper jaw plate, an upper handle and a pressure release lever rotatably coupled to the upper handle; and a lower stationary arm assembly including a lower jaw plate having a fulcrum extending from the lower jaw plate at a first angle to an outside surface of the lower jaw plate, a lower handle, a pressure adjustment bolt and a lock nut threaded onto the pressure adjustment bolt, the upper pivoting locking arm assembly and the lower stationary arm assembly being joined at a pivot hinge and being coupled by a spring and a pivoting pressure transfer arm coupled to the pressure release lever, wherein the fulcrum is adjustable along a guide member on the lower jaw plate and wherein the canvas stretching tool includes a securing member that can be tightened to secure the fulcrum at a given position on the guide member and loosened to permit the fulcrum to move freely along the guide member.

2. The canvas stretching tool of claim 1, wherein the first angle is in a range of about 80 degrees to 100 degrees, relative to the outside surface of the lower jaw plate.

3. The canvas stretching tool of claim 1, wherein a width of the upper jaw plate is in a range of about 30 mm to 80 mm.

4. The canvas stretching tool of claim 1, wherein a width of the lower jaw plate is in a range of about 30 mm to 80 mm.

5. The canvas stretching tool of claim 1, wherein a first width of the fulcrum is in a range of about 30 percent to 50 percent of a second width of the lower jaw plate.

6. The canvas stretching tool of claim 1, wherein a height of the fulcrum is in a range of about 12 mm to 20 mm.

7. The canvas stretching tool of claim 1, wherein the fulcrum is positioned on the outside surface of the lower jaw plate, substantially centered along a width of the lower jaw plate, and at one of a distal (leading) edge of the lower jaw plate or in a range of about 1 mm to 16 mm from the distal (leading) edge of the lower jaw plate.

8. The canvas stretching tool of claim 1, wherein the upper jaw plate and the lower jaw plate meet at a second angle in a range of about 0 degrees to 10 degrees.

9. The canvas stretching tool of claim 1, wherein the upper jaw plate includes an upper jaw plate gripping surface and the lower jaw plate includes a lower jaw plate gripping surface, and wherein the upper jaw plate gripping surface substantially meets the lower jaw plate gripping surface when the canvas stretching tool is closed.

10. The canvas stretching tool of claim 9, wherein the upper jaw plate gripping surface includes one of etching or a self adhesive slip resistant material.

11. The canvas stretching tool of claim 9, wherein the lower jaw plate gripping surface includes one of etching or a self adhesive slip resistant material.

12. The canvas stretching tool of claim 1, wherein a nose of the upper jaw plate at a distal edge of the upper jaw plate is one of blunt or chamfered at about a 30-degree to a 40-degree angle.

13. The canvas stretching tool of claim 1, wherein a nose of the lower jaw plate at a distal edge of the lower jaw plate is one of blunt or chamfered at about a 30-degree to a 40-degree angle.

14. The canvas stretching tool of claim 1, wherein back corners of the upper jaw plate are angled at a second angle in a range of about 30 degrees to 40 degrees.

15. The canvas stretching tool of claim 1, wherein back corners of the lower jaw plate are angled at a second angle in a range of about 30 degrees to 40 degrees.

16. The canvas stretching tool of claim 1, wherein the guide member includes a rail.

17. The canvas stretching tool of claim 1, wherein the guide member includes a groove.

18. The canvas stretching tool of claim 1, wherein the securing member includes a set screw.

19. The canvas stretching tool of claim 17, wherein the securing member includes a nut and a bolt, where the bolt extends through a hole in the fulcrum and through the groove and is secured by the nut on an opposite side of the groove from the fulcrum.

20. The canvas stretching tool of claim 1, wherein the fulcrum is spring-loaded.

* * * * *